US007299597B2

(12) United States Patent
Holt

(10) Patent No.: US 7,299,597 B2
(45) **Date of Patent: *Nov. 27, 2007**

(54) CONSTRUCTION CLIP

(76) Inventor: Lawrence Ray Holt, 3233 E. Margie Ave., Salt Lake City, UT (US) 84109

( * ) Notice: Subject to any disclaimer, the term of this patent is extended or adjusted under 35 U.S.C. 154(b) by 75 days.

This patent is subject to a terminal disclaimer.

(21) Appl. No.: 11/238,797

(22) Filed: Sep. 29, 2005

(65) Prior Publication Data

US 2006/0236645 A1 Oct. 26, 2006

Related U.S. Application Data

(63) Continuation-in-part of application No. 11/094,992, filed on Mar. 31, 2005.

(51) Int. Cl.
*E04C 5/00* (2006.01)

(52) U.S. Cl. ..... 52/712; 52/272; 52/285.3; 52/262; 52/98

(58) Field of Classification Search ..... 52/272, 52/285.3, 712, 293.3, 262, 271, 98, 100; 403/232.1, 286, 391, 174
See application file for complete search history.

(56) References Cited

U.S. PATENT DOCUMENTS

| | | | | |
|---|---|---|---|---|
| 3,293,819 | A * | 12/1966 | Heirich | 52/478 |
| 4,073,108 | A * | 2/1978 | Williams | 52/238.1 |
| 4,712,942 | A * | 12/1987 | Brown | 403/174 |
| 4,787,184 | A * | 11/1988 | Boidron | 52/217 |
| 5,161,909 | A * | 11/1992 | Crouse et al. | 403/391 |
| 5,918,427 | A * | 7/1999 | VanderWerf | 52/100 |
| 6,298,555 | B1 * | 10/2001 | Vincenti | 29/890.14 |
| 6,691,471 | B2 * | 2/2004 | Price | 52/169.12 |
| 2006/0225373 | A1 * | 10/2006 | Holt | 52/285.3 |

* cited by examiner

*Primary Examiner*—Basil Katcheves
(74) *Attorney, Agent, or Firm*—Workman Nydegger

(57) ABSTRACT

A clip for securing metal plates in walls constructed using masonry blocks. The clip includes a plate portion and a block portion. The block portion has members that form an opening that fits over a member of a masonry block. The plate portion also has members that form an opening that receives and secures a metal plate. When the block portion is placed on the member of a masonry block, the clip holds a metal plate in a fixed position relative to the masonry block. One member of the block portion can be angled. The block portion may also include a gripping portion that is used to secure the clip to a masonry block. The plate portion may include a spacer to secure the metal plate.

26 Claims, 6 Drawing Sheets

CONSTRUCTION CLIP

CROSS-REFERENCE TO RELATED APPLICATIONS

This application is a continuation-in-part of U.S. patent application Ser. No. 11/094,992 filed Mar. 31, 2005, which is hereby incorporated by reference in its entirety.

BACKGROUND OF THE INVENTION

1. The Field of the Invention

The present invention relates to construction. More particularly, embodiments of the invention relate to a construction clip used in the construction of concrete block structures.

2. The Relevant Technology

Cinder or concrete blocks are examples of materials that are frequently used in construction projects. When the walls of a building, for example, are constructed using concrete blocks, it is often necessary to insert metal plates into the wall at various locations. The metal plates are used to provide support for other portions of the construction project. After the metal plates are inserted into the wall, for example, an angle iron may be welded to the metal plates and used to support another structure such as a ceiling or an overhang.

Inserting the metal plates into the concrete block wall, however, presents several difficulties to construction workers and has an economic cost at least in terms of time and money. As a basic rule, the metal plates should be flush with the wall surface such that the angle iron can be successfully welded to the metal plates. This requires the metal plates to be properly positioned with respect to the wall. The issue faced by construction workers is ensuring that the metal plates can be properly positioned and then kept in that position until the plates can be permanently secured in place. In other words, the initial insertion of the metal plates is not permanent until other steps are completed. There is therefore a need to temporarily hold the metal plates in the proper position until they are permanently secured in position.

For example, the metal plates often have anchors and securing the metal plates often requires the use of grout that surrounds the anchors and holds the plates in the proper place. However, the plates need to be held in place until the grout can be added and cured. The concrete blocks may be filled with grout that is used to permanently secure the metal plates in the wall. When the grout is added, however, a vibrator is often used to remove air pockets and the like and to settle the grout within the concrete blocks. The vibrations, in addition to the force exerted by the grout itself, often have the detrimental effect of knocking out the metal plates. In addition, the pressure of the grout alone can cause the metal plates to become displaced.

Conventionally, wooden wedges are used to secure the metal plates in the concrete block wall while the grout is added and vibrated and often until the grout cures. Wooden wedges, however, are not efficient for many reasons. First, inserting the wooden wedges takes a substantial amount of time in order to insure that the metal plate is properly secured. Even then, the vibrator or the pressure of the grout can cause the metal plates to dislodge. Second, the time it takes to secure the metal plates with conventional wedges has an economic cost as it slows the masonry effort. There is therefore a need for systems and methods for inserting metal plates into concrete block walls.

BRIEF SUMMARY OF THE INVENTION

These and other limitations are overcome by embodiments of the invention, which relate to a construction clip. The construction clip can be used in construction projects, by way of example, that use masonry blocks such as cinder blocks or concrete blocks to build walls or other structures. In certain portions of these walls or other structures, metal plates are inserted and used to support another structure (such as a ceiling or overhang).

Each construction clip can be used to hold a metal plate in a fixed position or location relative to a masonry block until the metal plate is permanently attached. The construction clip includes a block portion that fits onto a member of the masonry block. The members of the clip's block portion have a width that is substantially equal to a width of the member of the masonry block. In addition, at least one of the members of the block portion may be angled.

At least one of the clip's members may have an edge with notches, which represent curves, protrusions, and the like, that enable the block portion to prevent the block portion from slipping on the block or to more securely grasp the block. The notches, or gripping portions can be formed in any portion of the clip's members to securely grasp the block and or the plate. In addition, the members of the block portion can be expanded or contracted to alter a width between the two members. Similarly, the members of the plate portion may also have some flexibility. Thus, one or both members may be flexible yet still retain a sufficient rigidity such that the metal plate is held in a fixed location.

The plate portion of the construction clip also has a pair of members that form an opening that receives a metal plate. These members can also be expanded or retracted by bending or flexing the members as needed to hold the metal plate securely. Each metal plate can be held in position using, for example a clip on the bottom of the plate and a clip on the top of the plate.

One member of the plate portion and one member of the block portion form a substantially flat surface that is usually flat against the wall. The plate is typically held in a fixed location such that a surface of the plate is flush with the surface of the wall. This enables an angle iron or other metal to be securely fixed to the metal plates that are inserted into the walls using one or more clips. The construction clip may further have a break portion that enables the members of the clip that form the flat surface to be more easily removed once the metal plates are secured in place.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to construction clips and more particularly to construction clips used to hold metal plates in a fixed location relative to masonry blocks used in construction situations. One of skill in the art can appreciate that the construction clips can be adapted to secure other structures in place during construction projects.

When building a wall or other structure, it is often necessary to insert metal plates into the walls. The metal plates can then be used to support another structure such as a ceiling or overhang or for other purposes. The metal plates, once fixed to the walls, can then provide the support needed to construct additional structures. Typically, the clips hold the metal plates in position until the metal plates are permanently fixed in position. The clips prevent the metal plate from being dislocated, for example, by grout added to the interior of the cinder blocks or by other construction processes (such as grout vibration) that exert forces on the metal plate.

The principles of the present invention are described with reference to the attached drawings to illustrate the structure and operation of example embodiments used to implement the present invention. Using the diagrams and description in this manner to present the invention should not be construed as limiting its scope. Additional features and advantages of the invention will in part be obvious from the description, including the claims, or may be learned by the practice of the invention. Detailed descriptions of well-known components and other construction techniques are omitted so as not to unnecessarily obscure the invention in detail. Further, the drawings are not necessarily drawn to scale.

Figure 1A:
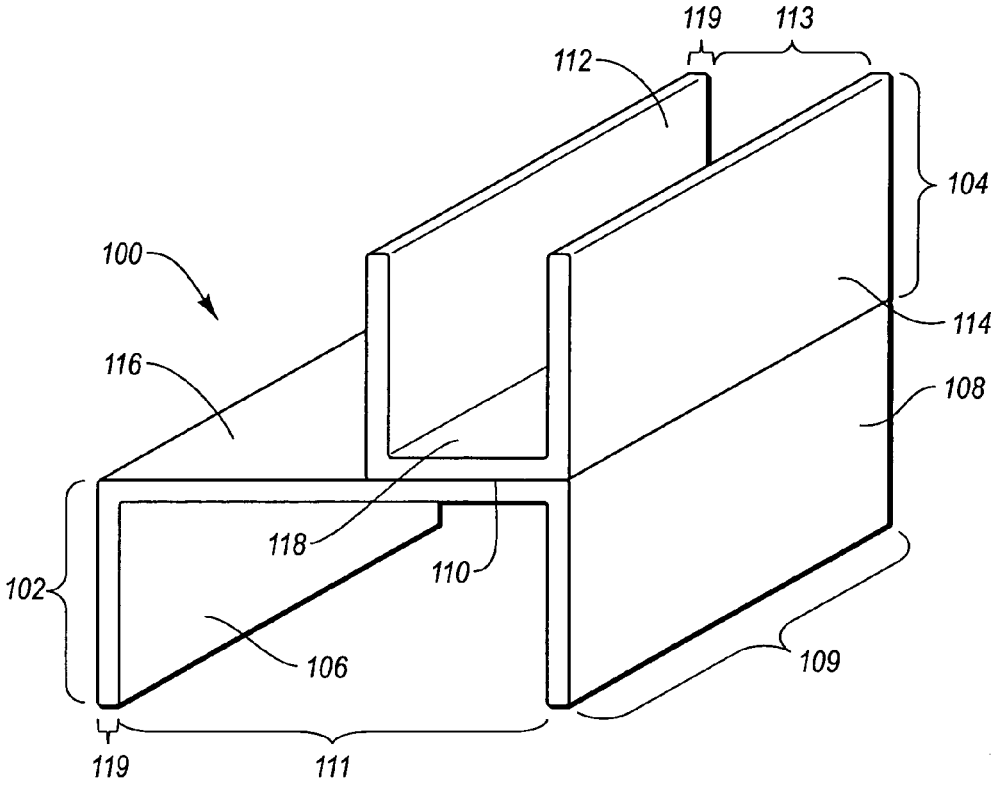
FIG. 1A illustrates a perspective view of one embodiment of a construction clip.

FIG. 1A illustrates a perspective view of one embodiment of a construction clip 100. The clip 100 can be used in construction to hold a metal plate in a particular location relative to other masonry blocks in a wall, for example, as the wall is constructed. In this example, the clip 100 and in particular the block portion 102 can fit over a portion or a member of a masonry block (such as a cinder block, a concrete block, or other masonry block or brick). A plate portion 104 receives a bottom of a metal plate. As the next few rows of the wall are built, another clip may be used to hold the other top member of the metal plate relative to another masonry block. In this manner, the plate is held in place by a pair of clips 100 and the conventional need to used wedges to hold the metal plate in position is eliminated. Further, the construction of the wall can be performed at a faster pace as the use of a clip takes seconds while using wedges can consume significantly more time. Also, the metal plate is less likely to become displaced from the wall when the grout is added, or when a vibrator is used to settle the grout, for example.

In this example, the clip 100 includes a block portion 102 and a plate portion 104. The block portion 102 and the plate portion 104 can be made of metal and then bonded or welded together at location 110. Alternatively, the block portion 102 and the plate portion 104 can be molded from another material such as plastic. Thus, the block portion 102 and the plate portion 104 can form an integral molded clip. One of skill in the art can appreciate other adequate materials and other adequate methods of securing the block portion 102 to the plate portion 104.

Figure 1B:
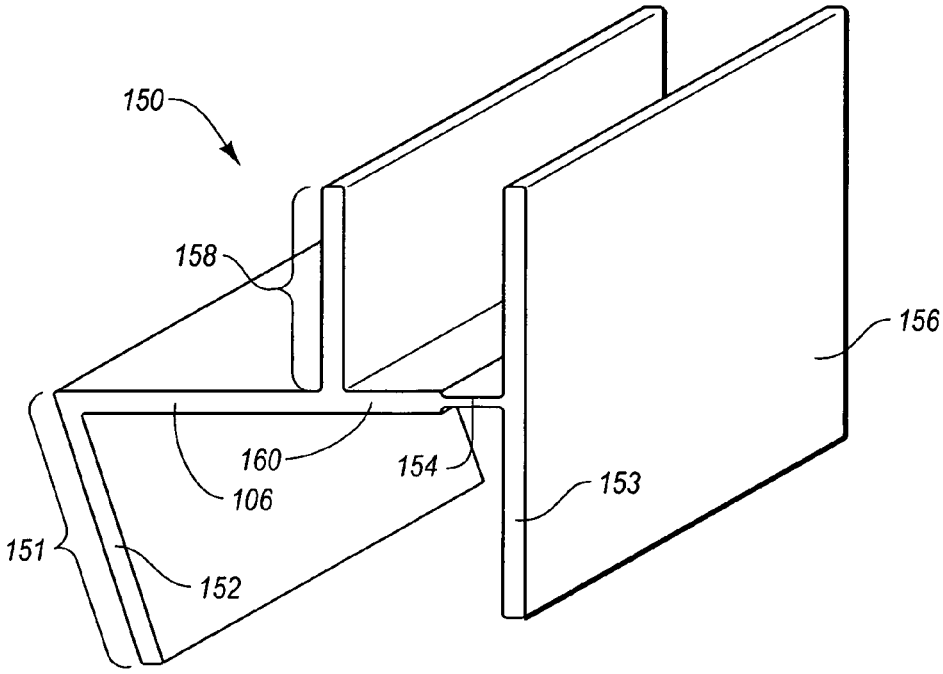
FIG. 1B illustrates another perspective view of one embodiment of a construction clip with a break portion.

The block portion 102 includes a member 106, a base 116, and a member 108. The members 106 and 108 along with base 116 form a U shaped opening that has a width 111 between the members 106 and 108. The shape of the opening can be adapted to accommodate the block, such as shown in FIG. 1B, for example. The plate portion 104 includes a member 112, a base 118, and a member 114. The members 112 and 114 along with the base 118 also form a U shaped opening that has a width 113 between the members 112 and 114. The widths 111 and 113 can be contracted or expanded by moving one or both members. Typically, the member 114 of the plate portion 104 and the member 108 of the block portion 102 should present a substantially flush surface or be substantially flat. Thus, the members 112 and 106 are usually adjusted to accommodate plates and blocks of varying widths.

In this example, the member 106 and the member 112 have some flexibility without losing the ability to securely hold a metal plate. In other words, even after adjusting one or both of the members 112 and 106, these members still have sufficient rigidity to insure that the metal plate is held in a fixed position relative to a masonry block. For example, the members 106 and/or 112 may be flexible and can be bent inwards or outwards to accommodate varying sized of concrete blocks and metal plates. Further, the ability to bend a member can enhance the ability of the clip 100 to secure a metal plate. As a result, the member 106, for example, may be angled inwards toward the member 108 of the block portion 102.

The members of the plate portion and of the block portion can each create a friction fit. In one example, the friction fit is a result of the natural tendency of the clip to return to its original shape. As the members of the block portion are slightly separated in order to be placed on a concrete block, the clip will exert a natural force against the construction block. This can secure the clip to both the masonry block and the metal plate. In some instances, a tight fit of the metal plate in the opening of the plate portion is not required and the plate can fit loosely. The members of the clip will prevent the plate from being displaced from the wall after subsequent rows are constructed. Advantageously, the clip 100 can hold the metal plate in position quickly and efficiently until the metal plate is permanently secured with grout.

The dimensions of the clip 100 can vary and may be related to a particular construction need. The block portion 102 and the plate portion 104 may each have a length 109 between ⅛ inch to 9 inches. The width 113 of the plate portion 104 may be, by way of example, ¾ inches and the width 111 of the block portion 102 may be 1 and ¾ inches.

The thickness 119 of the block portion 102 and the plate portion 104 can be, by way of example, ⅛ inch. One of skill in the art can appreciate that the clip 100 is not limited to these dimensions and that they are provided by way of example only. Further, the dimensions of the plate portion 104 do not have to be the same as the dimensions of the block portion 102. For example, the length of the plate portion 104 can be shorter or longer than a length of the block portion 102.

FIG. 1B illustrates another embodiment of the construction clip 150, which is generally similar to the clip 100. In this example, the member 152 of the block portion 151 is angled inward toward the member 153 of the block portion. In addition, the member 152 may have a length that is longer or shorter than the length of the member 153. This configuration enables the block portion 151 and in particular the member 152 to effectively grip a concrete block as well as facilitate the placement of the clip onto a concrete block.

The faceplate 156 of the clip 150, which is effectively formed by certain of the members of the plate portion 158 and the block portion 151, is exposed once the clip 150 has been installed. In FIG. 1B, the clip 150 also includes a base 160 with a break portion 154. The break portion 154 facilitates the removal of the faceplate 156 after the metal plate is secured in the construction project. Thus, the break portion 154 has less thickness than other portions of the base 160. Alternatively, the break portion 154 may include perforations in addition to or in place of a reduced thickness. At the same time, the break portion 154 has sufficient strength to hold the metal plate in place. The faceplate 156 can be removed, by way of example and not limitation, using heat such as welding, a shearing force, a cutting instrument, and the like or any combination thereof.

Figure 1C:
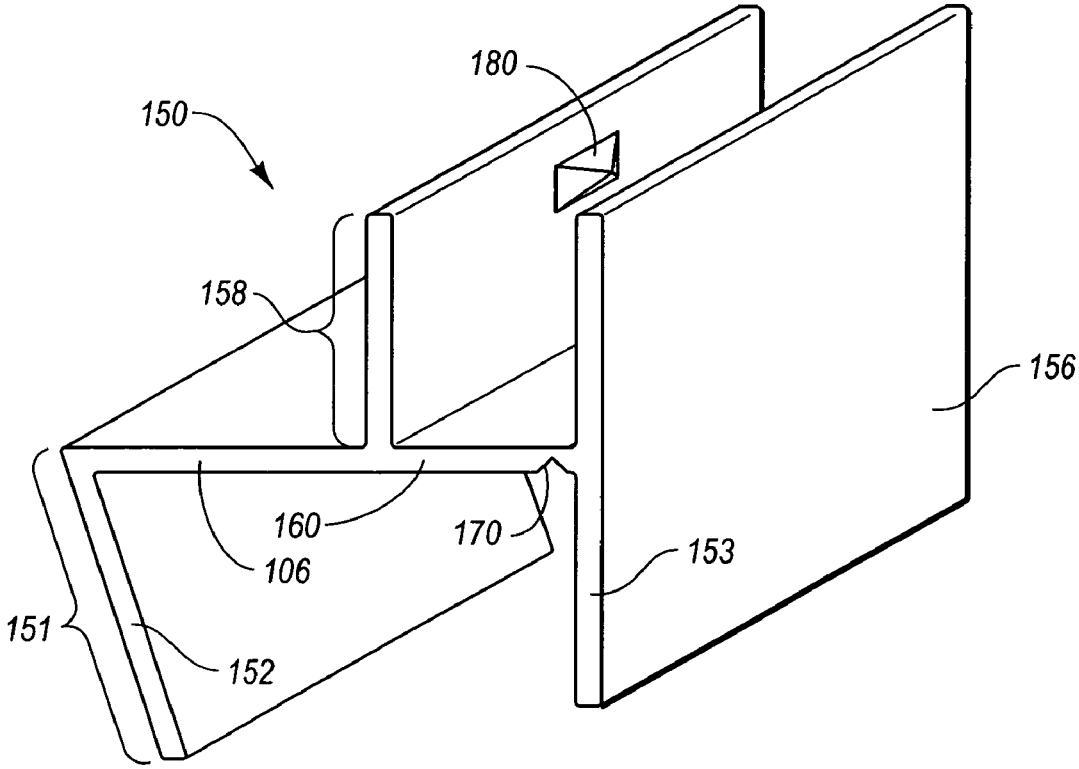
FIG. 1C illustrates another perspective view of one embodiment of a construction clip where the break portion includes a notch.

FIG. 1C illustrates another embodiment of the clip 150. In FIG. 1C, the break portion includes a notch 170 that is formed adjacent the faceplate 156. The notch 170 facilitates the removal of the faceplate 156 as previously described. In one embodiment, a trowel can be used to remove the faceplate 156. A peak of the notch 170 may be located adjacent the faceplate 156. The blade of the trowel can cut through the clip at or near the notch 170, thereby removing the faceplate 156. As previously stated, the clip 150 may be formed or molded from plastic. The notch 170 can be formed in the base 160 on either side of the base 160. FIG. 1C illustrates the notch 170 within the plate portion of the clip 150. The notch 170, however, could also be formed in the block portion or in both the plate and block portions. One of skill in the art can appreciate that the notch 170 can be formed in other manners apparent to one of skill in the art with the benefit of this disclosure.

The member 112 (see FIG. 1A) of the plate portion 158 may also have a spacer 180 formed thereon. The spacer can be located at any portion of the body of the member 112 including the edges and/or sides. In this example, the spacer 180 is extends out from the body of the member 112 into the space of the plate portion 158 that receives the metal plate. This enables a clip 150 to more securely grip a metal plate (or other construction block) and helps ensure that the metal plate is positioned against the faceplate 156. The spacer 180 may come to a point or present another surface (flat or curved) to the metal plate within the opening of the plate portion 158. The spacer 180 can have various dimensions as well. The spacer 180, by way of example and not limitation, may be ⅛-¼ inch wide and positioned ¼ inch down from the top of the member 112. The spacer 180 may also be centered.

Figure 2A:
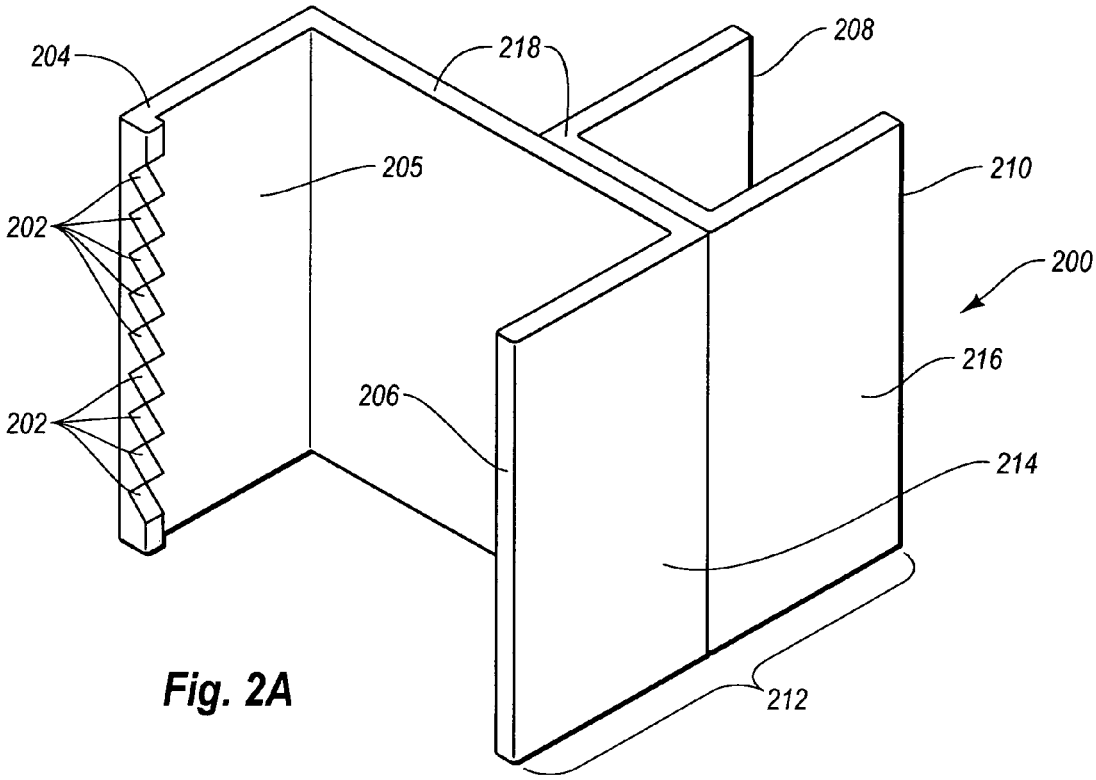
FIG. 2A illustrates another perspective view of another embodiment of a construction clip that includes a gripping member.

FIG. 2A illustrates a perspective view of another embodiment of a construction clip 200. In this example, the clip includes a plate portion 216 that is securely connected with the block portion 214 at the base 218. The surface 212 of the faceplate formed by the members 206 and 210 is substantially flat as previously described and, when the clip is used in constructing a wall, the surface 212 is typically flat against the surface of the wall. The surface 212 is considered to be substantially flat even when the corresponding members on the block portion and the plate portion are not perfectly aligned. In other words, the members of the block portion and the plate portion that make up the surface 212 may be offset. In certain situations, it may be desirable to have an offset. In some embodiments, these members do not form a substantially flat surface, but are offset. For example, an offset may be used when the metal plate is intended to be inset with respect to the surface of the wall. The offset can be determined by particular use.

Figure 5:
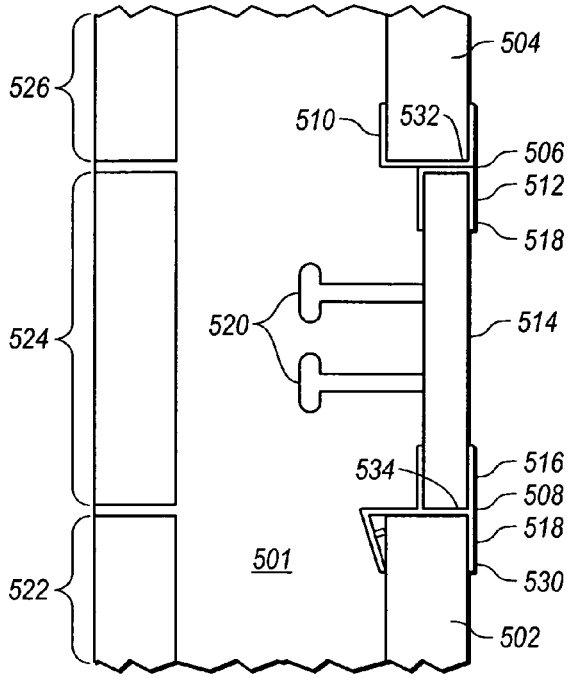
FIG. 5 is a member view of a metal plate built into a concrete block wall and secured using construction clips.

The clip 200 may also include a gripping portion that is used to hold the clip in place when in use or to improve the ability of the clip 200 to hold a metal plate in the proper location as the construction project proceeds. In this case, the gripping portion is an edge 204 of the member 205. The edge 204 has notches 202 formed therein. The notches 202 enable the block portion 214 to more securely grasp a concrete block as illustrated in FIG. 5, for example. The notches can be pointed or rounded. The notches 202 are intended to represent any type of protrusion, rib, or ridge that can be formed to provide an edge that more securely grasps a masonry block. The notches 202 can enhance the ability of the clip 100 to connect with a masonry block when the clip is placed onto a member of the masonry block.

The edges 208, 210, and 206 do not include notches 202 in this example, but these edges are not precluded from having notches. In one embodiment, the edges 210 and 206 do not have notches in order to ensure that the surface 212 is substantially flat. This enables a front surface of the metal plate to be substantially flush with the wall surface. Notches or ridges on the edge 210 can result in the metal plate being inset from a surface of the wall. An inset plate cannot be easily secured to an angle iron, as discussed below with reference to FIG. 6.

Figure 2B:
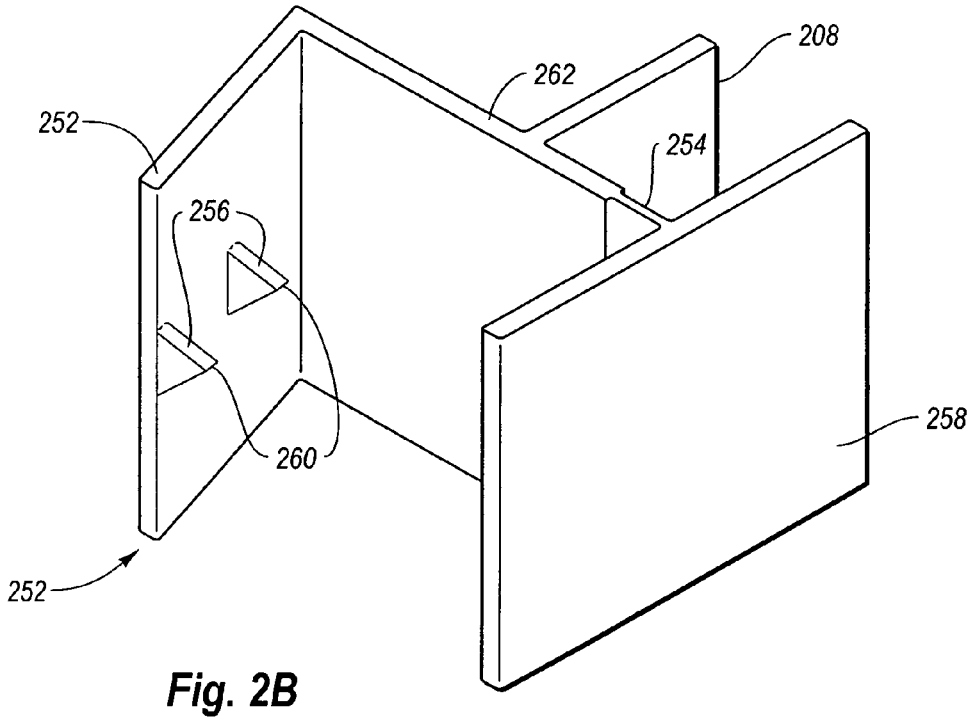
FIG. 2B illustrates yet another perspective view of a construction clip where one member is angled and further illustrates another embodiment of a gripping member.

FIG. 2B illustrates another embodiment of a construction clip 250. In this example, the clip 250 also includes a break portion 254. The member 252 is also angled inward towards the member 258. The clip 250 includes a gripping portion 256 that extends out from the member 252 towards the member 258. The gripping portion 256 can be of any form or shape and can be formed or connected to any part of the member 252 or to another portion of the clip 250. The gripping portion 256 can have an end 260 that is rounded, pointed, or the like. The gripping portion 256 may extend out parallel to the base 260 or may be angled. The end 260 of the gripping portion 256 may also be angled with respect to the rest of the gripping portion 256. For example, angling the gripping portion 256 towards the plate portion may make it easier to place the clip on a block and then help prevent the clip from slipping up, thereby securing the metal plate in place.

While FIG. 2B illustrates a particular shape and location for the griping portion 256, one of skill in the art can appreciate other forms and/or locations for the gripping portion 256. For example, the member 252 may only have a single gripping portion 256 instead of the two illustrated. The gripping portion 256 can be located on the ends or edges of the member 252 as shown in FIGS. 2A and 2B. The gripping portion 256 can be located at any location of the body of the member 252. The gripping portion 256 may be centered on the member 252 or located more towards the sides.

Figure 3:
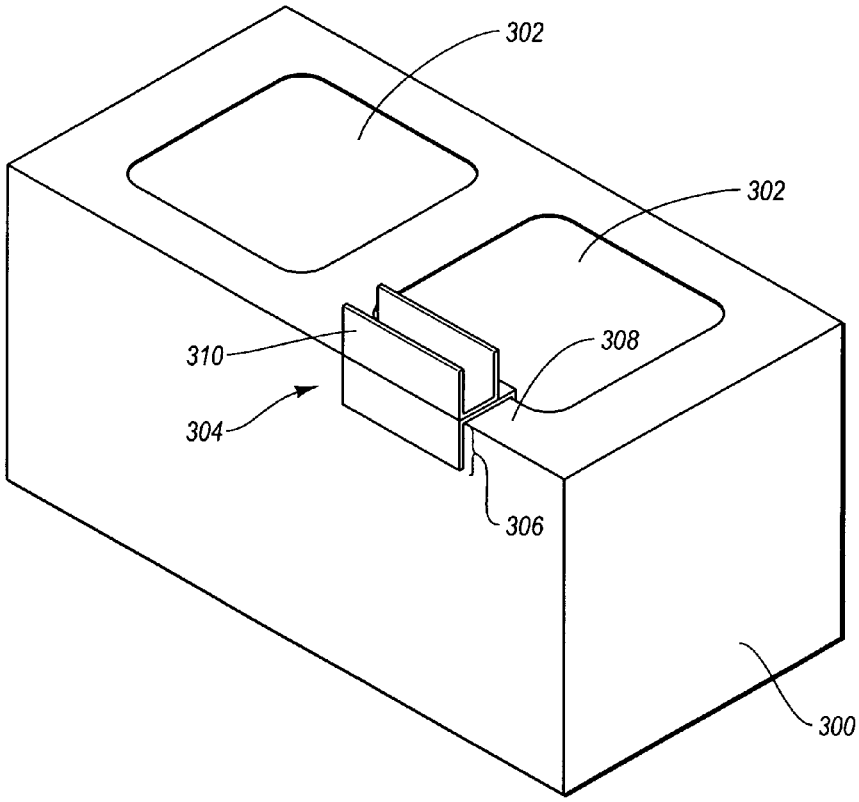
FIG. 3 illustrates a construction clip mounted on a concrete block.

FIG. 3 illustrates a construction clip 304 that is mounted on a masonry block such as the cinder block 300. The clip 304 is representative of all embodiments of the clip disclosed herein. A cinder block 300 often has openings 302 formed therein. The block portion 306 of the clip 304 fits over the edge 308 of a member of the cinder block 300. When the clip 304 is placed in this position, the plate portion 310 is ready to receive a metal plate in the U shaped opening formed by the members of the plate portion. When the clip 304 is placed on the side or edge 308 of the cinder block 300, the member of the block portion within the opening 302 can be moved to more securely attach the clip 304 to the block 300. This can be performed before placing the clip on the block, after placing the clip on the block, or by removing the clip, adjusting the location of the member, and then replacing the clip on the block. Alternatively, the width between the members of the block portion 306 of the clip 304 can be adjusted such that some force is required to push the clip 304 onto the member or edge 308 of the block 300. As previously discussed, an edge of the member or the member itself that is inside the opening 302 may have notches or another type of gripping portion to provide a firmer grasp on the block 300.

Figure 4:
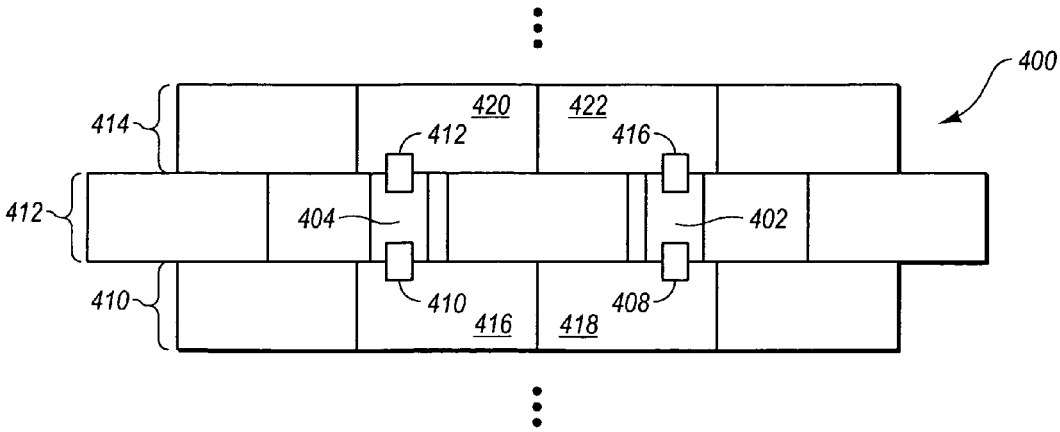
FIG. 4 illustrates a concrete block wall that included metal plates held in place by construction clips.

As the wall is built using cinder blocks, and as illustrated in FIG. 4, the metal plates 404 and 402 can then be securely held in a wall 400 in a fixed location relative to surrounding masonry blocks. In this example, the plate 404 is held by the clips 410 and 412 in a fixed location relative to surrounding masonry blocks while the plate 402 is held by the clips 406 and 408 in a fixed location relative to surrounding masonry blocks.

During construction of the wall 400, the row 410 is built and the clips 410 and 408 are placed respectively on sides or edges of the blocks 416 and 418 as illustrated in FIG. 3. Next, the row 412 is constructed and a space is left open for the plates 404 and 402. This can be achieved by cutting the masonry blocks or by leaving a space for the metal plates.

Next, the row 414 is built on top of the row 412. At this point or when convenient, the metal plates are inserted into the plate portions of the clips 410 and 408. Then the plate portions of the clips 412 and 406 are placed on the top members of the metal plates 404 and 402. Finally, the blocks 420 and 422 are placed and received into the U shaped openings of the block portions of the clips 420 and 422. Once this is done, the plates 404 and 402 are held in place. The clips typically hold the metal plates in a manner such that the metal plates are flush with the wall 400.

FIG. 5 illustrates a member view of a wall that includes a metal plate secured with construction clips. FIG. 5 illustrates three blocks 526, 524, and 522 that are part of a wall. The plate 514 has been inserted into the wall and part of the block 524 has been removed to accommodate the plate 514. In this example, the clip 518 is used to secure a bottom portion of the plate 514. The plate portion 516 receives the bottom of the plate 514 while the block portion 518 of the clip 508 is placed over the member 502 of the block 522.

The clip 506 is similarly positioned. The plate portion 512 is placed onto the top portion of the plate 514 and the block portion 504 of the clip 506 receives the member 504 of the block 526. Once the block 526 is in position, the plate 514 is unlikely to move and is held in place by the clips 506 and 508.

The clips 506 and 508 also hold the plate 514 in the correct position with respect to the wall. Thus, the front surface of the plate 514 is properly positioned in the wall and is, in one example, flush with the surface of the wall. The clips can improve the speed with which the wall is constructed because placing the clips onto the blocks requires a minimal amount of time, as opposed to trying to properly position the plate 514 using wedges.

In this example, the interior space 501 may be filled, for example, grout. The plate extensions 520 are then surrounded by the grout. When the grout cures, the plate 514 is permanently inserted into the wall. As previously stated, a vibrator may be used to eliminate air bubbles from the grout. The clips 508 and 506, however, prevent the plate 514 from being displaced during vibration or by the pressure exerted by the grout.

As further illustrated in FIG. 5, the clips 506 includes a break portion 532 and the clip 508 includes a break portion 534. As discussed above, the break portions 532 and 534 may be less thick than other portions of the bases of the clips 506 and 508. The break portions 532 and 534 facilitate the removal of the faceplates 528 and 530 after the plate 514 is secured in place.

Figure 6:
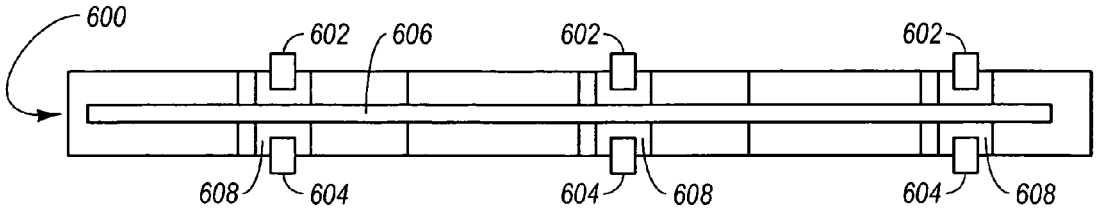
FIG. 6 illustrates an iron securely connected to one or more metal plates mounted in a wall.

In many situations, there is no need to remove the clips. As illustrated in FIG. 6, an angle iron 606 or other metal may be welded to the metal plates 608 that are in the row 600 of cinder or concrete blocks. The clips 604 and 602 do not interfere with the ability to weld the iron 606 to the plates 608. In situations where the iron 606 covers the clips 604, the clips 604 or the faceplates of the clips 604 typically burn or melt away during the welding process. In this example, the clips 602 and 604 have properly positioned the plates 608 such that the iron 606 can be mounted against the row 600. As previously described, however, the faceplates can be removed from the clip. The removal of the faceplates can be facilitated by the inclusion of break portions in the construction clips.

Figure 7:
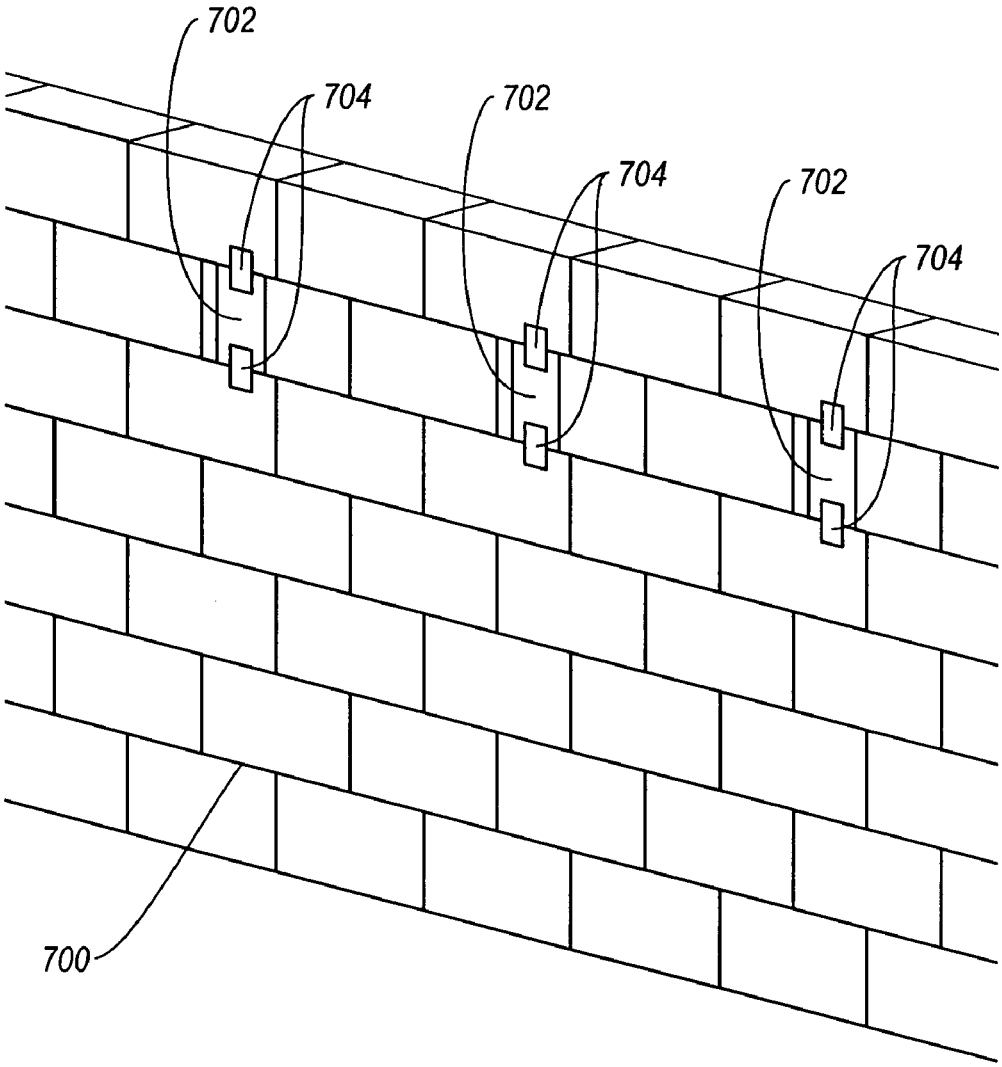
FIG. 7 illustrates another example of metal plates inserted into a wall using embodiments of a construction clip.

FIG. 7 illustrates another example of a construction project. This project includes a wall 700 that includes multiple plates 702 inserted or included in the wall 700. The plates 702 are secured by the clips 704. Once the plates 702 are secured in the wall 700, such as when the grout is cured, the faceplates of the clips 704 can be removed if desired. When the clips 704 are made of metal, the faceplates can be removed, by way of example and not limitation, using a welding process, a cutting process, or a shearing process. Plastic clips can be removed in a similar manner.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A clip used to secure metal plates in a wall constructed with blocks, the clip comprising:

at least one base;

a plate portion extending out from the at least one base, the plate portion having a first member and a second member that form a first opening to receive a plate;

a block portion extending out from the at least one base in a direction different from the plate portion, the block portion having a third member and a fourth member that form a second opening to receive a block, the first member of the plate portion and the fourth member of the block portion forming a frangible and substantially planar surface;

a line of weakness formed in the base near the first member and the fourth member to facilitate the removal of the frangible and substantially planar surface, the line of weakness comprising a first portion of the base near the first member and the fourth member having a thickness that is less than a thickness of a second portion of the base near the second and third member; and a gripping portion extending out from the third member and adapted to grip the block.

2. A clip as defined in claim 1, wherein the second member further comprises a spacer that extends into the first opening.

3. A clip as defined in claim 2, wherein the spacer extends out from a body of the second member to a point adapted to contact a metal plate and secure the metal plate within the first opening.

4. A clip as defined in claim 1, wherein the gripping portion further comprises an edge that has one or more notches or curves.

5. A clip as defined in claim 1, wherein the at least one base, the first member, the second member, the third member, and the fourth member each comprise metal.

6. A clip as defined in claim 1, wherein the at least one base, the first member, the second member, the third member, and the fourth member each comprise plastic.

7. A clip as defined in claim 1, wherein the third member has a length that is longer than a length of the fourth member.

8. A clip as defined in claim 1, wherein the first opening has a width that is less than a width of the second opening.

9. A clip as defined in claim 1, wherein the first member and the fourth member form a substantially flat surface.

10. A clip as defined in claim 1, wherein the third member is angled towards the fourth member.

11. A clip as defined in claim 9, wherein the gripping portion extends out from the fourth member in a direction parallel to the at least one base.

12. A clip as defined in claim 11, wherein the break portion has one or more of a thickness that is less than a thickness of the at least one base or perforations that facilitate the removal of a faceplate formed by the first member and the fourth member.

13. A clip as defined in claim 1, wherein the at least one base further comprises a break portion near the first member and the fourth member.

14. In a construction environment using blocks to build one or more walls, wherein metal plates are inserted into the walls, a clip for use in securing the metal plates in the walls until the metal plates are permanently fixed in the walls, the clip comprising:

a plate portion extending from a first side of a base, the plate portion having a first member and a second member that form a first opening to receive a plate;

a block portion extending out from a second side of the base, the block portion having a third member and a fourth member that form a second opening to receive a block, wherein the first member of the plate portion and the third member of the block portion form a frangible faceplate having a substantially flat surface; and a line of weakness formed in the base near a junction between the first member and the third member, the line of weakness comprising a first portion of the base having a thickness less than that of a thickness of a second portion of the base near the second and fourth member, which facilitates the removal of the frangible faceplate.

15. A clip as defined in claim 14, wherein the plate portion has a length that is the same as a length of the block portion.

16. A clip as defined in claim 14, wherein the plate portion has a length that is different from a length of the block portion.

17. A clip as defined in claim 14, wherein a width between the first and second members of the plate portion is less than a width between the third and fourth members of the block portion.

18. A clip as defined in claim 14, the fourth member comprising a gripping portion extending out from a face of the fourth member towards the third member.

19. A clip as defined in claim 18, wherein the gripping portion is formed at an edge of the fourth member and wherein the gripping portion comprises notches formed in the edge.

20. A clip as defined in claim 18, wherein the gripping portion is angled to facilitate insertion of the block portion onto a side of a construction block, wherein the gripping portion contacts the construction block to hold the clip in place.

21. A clip as defined in claim 18, wherein the break portion comprises one or more of a thickness that is less than a thickness of the base or perforations.

22. A clip as defined in claim 21, wherein the break portion forms a notch in the base, the notch having a point that is adjacent the faceplate.

23. A clip as defined in claim 14, wherein the second member of the plate portion further comprises a spacer that extends from the second member into the first opening.

24. A clip as defined in claim 23, the spacer having a point configured to secure a metal plate within the first opening.

25. A clip as defined in claim 23, wherein the clip comprises molded plastic.

26. A method for securing metal plates in a block wall, the method comprising:

providing a clip comprising:

a plate portion extending from a first side of a base, the plate portion having a first member and a second member that form a first opening to receive a plate;

a block portion extending out from a second side of the base, the block portion having a third member and a fourth member that form a second opening to receive a block, wherein the first member of the plate portion and the third member of the block portion form a frangible faceplate having a substantially flat surface; and a line of weakness formed in the base at near a junction between the first member and the third member, the line of weakness comprising a first portion of the base having a thickness less than that of a thickness of a second portion of the base near the second and fourth member, which facilitates the removal of the frangible faceplate;

placing the clip on a block such that the block portion receives the block;

placing a metal plate in the plate portion of the clip;

applying an adhesive material between the block and the metal plate such that the metal plate is secured to the block; and applying a shear force to the frangible faceplate of the clip in order to remove the faceplate from the clip.

* * * * *